US005878895A

United States Patent [19]

Springs

[11] Patent Number: 5,878,895

[45] Date of Patent: Mar. 9, 1999

[54] FRONT LOADING PACKAGE DISPLAY SYSTEM

[75] Inventor: Keith A. Springs, Germantown, Tenn.

[73] Assignee: Newell Operating Company, Ill.

[21] Appl. No.: 885,474

[22] Filed: Jun. 30, 1997

[51] Int. Cl.[6] ..... A47F 5/00

[52] U.S. Cl. ..... 211/59.3; 211/59.2; 211/74; 312/71

[58] Field of Search ..... 312/42, 71; 211/59.2, 211/59.3, 74

[56] References Cited

U.S. PATENT DOCUMENTS

| | | | |
|---|---|---|---|
| 1,760,346 | 5/1930 | Correa . | |
| 3,083,067 | 3/1963 | Vos et al. . | |
| 3,161,295 | 12/1964 | Chesley . | |
| 3,240,455 | 3/1966 | Swezy et al. . | |
| 3,261,010 | 7/1966 | Kardel . | |
| 3,308,961 | 3/1967 | Chesley . | |
| 3,687,336 | 8/1972 | Gayle . | |
| 3,698,798 | 10/1972 | Bolton . | |
| 3,703,964 | 11/1972 | Field . | |
| 3,767,084 | 10/1973 | Bayha . | |
| 3,780,873 | 12/1973 | Silva . | |
| 3,845,882 | 11/1974 | Hass . | |
| 3,854,625 | 12/1974 | Kuebler . | |
| 4,042,096 | 8/1977 | Smith . | |
| 4,200,201 | 4/1980 | Collins et al. . | |
| 4,300,693 | 11/1981 | Spamer . | |
| 4,706,821 | 11/1987 | Kohls et al. . | |
| 4,724,968 | 2/1988 | Wombacher . | |
| 4,730,741 | 3/1988 | Jackle, III et al. . | |
| 4,742,936 | 5/1988 | Rein | 312/71 X |
| 4,762,236 | 8/1988 | Jackle, III et al. . | |
| 4,907,707 | 3/1990 | Crum . | |
| 5,012,936 | 5/1991 | Crum . | |
| 5,111,942 | 5/1992 | Bernardin | 211/59.3 |
| 5,123,546 | 6/1992 | Crum . | |
| 5,531,336 | 7/1996 | Parham et al. | 211/59.2 X |
| 5,562,217 | 10/1996 | Salveson et al. | 312/71 X |
| 5,673,801 | 10/1997 | Markson | 211/59.3 |
| 5,685,664 | 11/1997 | Parham et al. | 211/59.3 X |

*Primary Examiner*—Robert W. Gibson, Jr.
*Attorney, Agent, or Firm*—Foley & Lardner

[57] ABSTRACT

A product display and dispensing system includes a tray, a pusher member and a product spacer. The tray has a rear end, a front end and a front wall at the front end. The tray is configured for supporting a series of products between the rear end and the front end. The pusher member is movably supported between the rear end and the front end for pushing the series of products towards the front end. The product spacer is supported proximate the front end and spaced from the front wall for engaging a frontward most product of the series of products to space the frontward most product from the front wall.

27 Claims, 2 Drawing Sheets

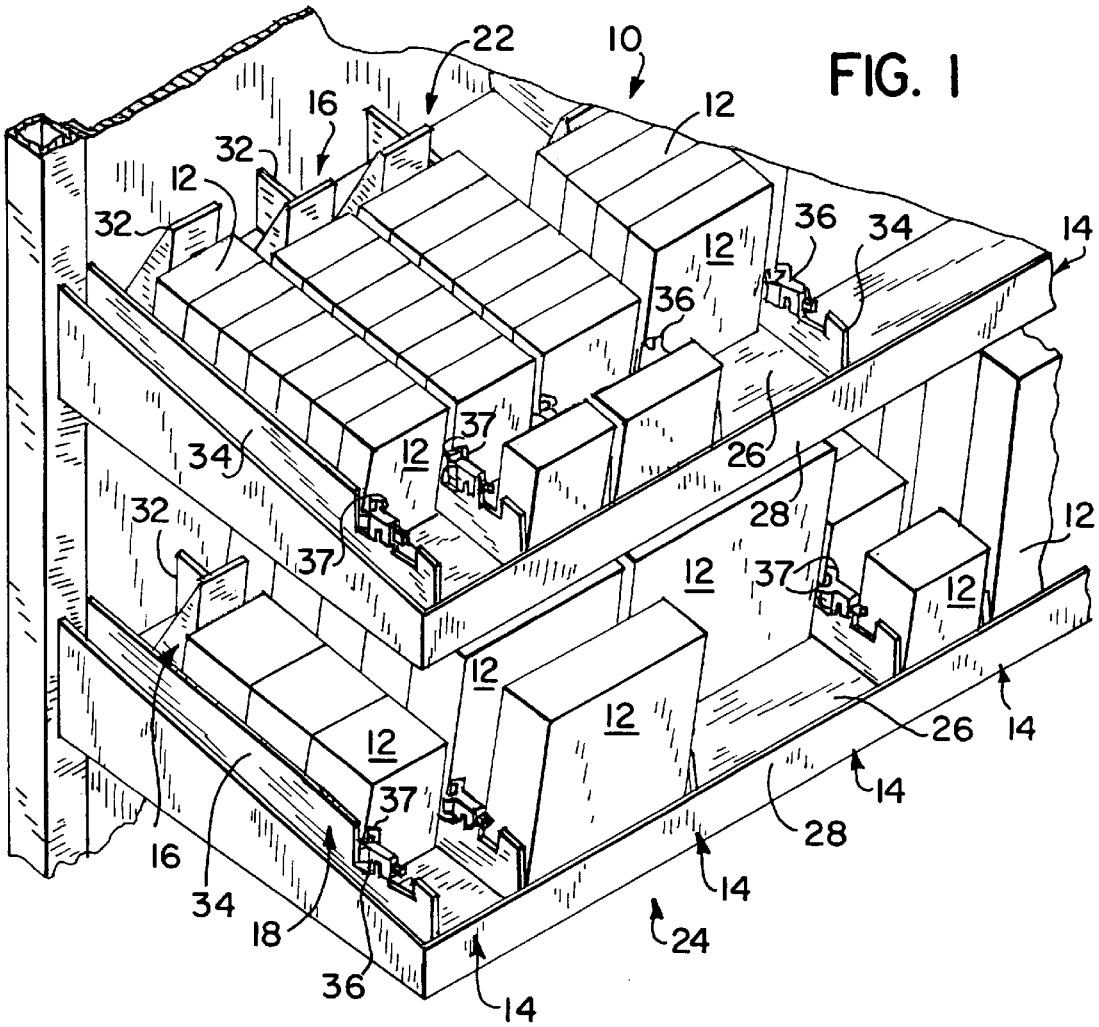
FIG. 1
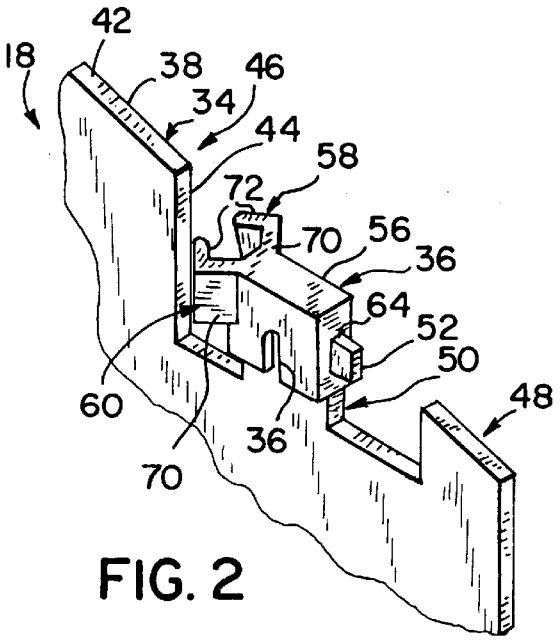
FIG. 2
FIG. 7
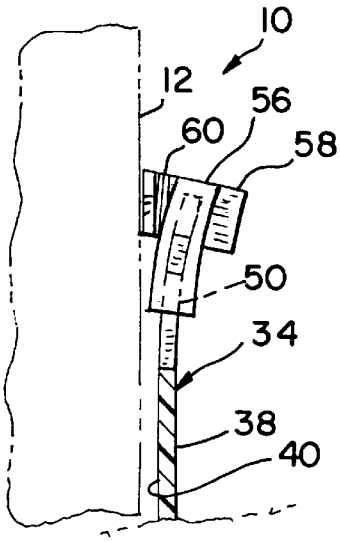

FRONT LOADING PACKAGE DISPLAY SYSTEM

FIELD OF THE INVENTION

The present invention relates to a system for displaying and dispensing a series of products. In particular, the present invention relates to a product spacer and a product flow guide to be used as part of the displaying and dispensing system to direct movement of the series of products between a rear end and a front end of the system.

BACKGROUND OF THE INVENTION

Product display and dispensing systems, also known as merchandisers, are commonly used in the retail industry for displaying as well as dispensing a series of stacked products. Typical product display and dispensing systems include a tray configured for containing the series of products and a pusher member for engaging a rearward most product to automatically push the entire series of products toward the front end of the tray as a customer removes the forward most product. To prevent the pusher member from pushing the products out of the tray, the tray includes a front wall that engages the frontward most product of the series of products. As a result, the products can be always easily seen and removed by customers.

During the merchandising of products, the products are frequently removed from the tray for further customer inspection. Once an individual product is removed from the tray, the pusher member automatically forces the next succeeding product towards the front into engagement with the front wall of the tray. As a result, for the customer to return the removed product to the tray after inspection, the customer must attempt to push back the entire series of products in order to create a space while holding on to and returning the removed product to the tray. Because the frontward most product is pressed against the front wall of the tray, only the top edge or upper portion of the product may be accessed. As a result, it is sometimes difficult to grasp the frontward most product to push the entire series of products towards the rear of the tray. Because returning the removed product to the tray can be frustrating and time consuming, the consumer will often simply leave the removed product on the floor or upon an incorrect shelf creating a disorganized and cluttered aisle or display area.

In addition, conventional product display and dispensing systems are also difficult to reload with products when the number of products contained in the tray is low. Because the pusher member automatically forces the next succeeding product against the front wall of the tray, the product stocker must push back all of the remaining products while reloading any new products into the tray.

Moreover, absent any support during reloading, newly inserted products frequently tip either forwardly or rearwardly within the tray to further complicate reloading. Consequently, reloading the product display and dispensing system is also difficult and time consuming.

SUMMARY OF THE INVENTION

The present invention is directed to a product display and dispensing system including a tray, a pusher member and a product spacer. The tray has a rear end, a front end and a front wall at the front end. The tray is configured for supporting a series of products between the rear end and the front end. The pusher member is movably supported between the rear end and the front end for pushing the series of products towards the front end. The product spacer is supported proximate to the front end and spaced from the front wall for engaging a frontward most product of the series of products to space the frontward most product from the front wall.

The present invention is more specifically directed to a product displaying and dispensing system wherein the tray includes a first sidewall extending between the rear end and the front end and wherein the product spacer is supported by the first sidewall. In the most preferred embodiment, the tray is also provided with a second sidewall opposite the first sidewall and a second product spacer supported by the second sidewall. In the preferred embodiment, the pusher member engages a first side of the series of products and the product spacer engages a second opposite side of the series of products.

The present invention is also directed to a product flow guide for use with a product display and dispensing system having a tray with a front end, a rear end and a front wall at the front end, and a pusher member movably supported between the rear end and the front end for pushing a series of products towards the front end. The product flow guide includes a support structure configured for being supported adjacent the tray between the front end and the rear end and at least one wing projecting from the support structure. The wing is configured for engaging a frontward most product of the series of products to space the frontward most product from the front wall.

The present invention is more specifically directed to a product flow guide wherein the tray extends along an axis between the rear end and the front end, wherein the support structure extends parallel to the axis and wherein the wing extends oblique to the axis. Preferably, the support structure comprises a side wall extending along one side of the tray for guiding the series of products from the rear end towards the front end. The wing preferably includes a body configured for being removably attached to the side wall. In addition, the wing is preferably resiliently flexible so as to resiliently deform towards the rear end of the tray in response to a rearward force. In the most preferred embodiment, the product flow guide includes a first wing projecting from the support structure on a first side of the support structure and a second wing projecting from the support structure on a second opposite side of the support structure.

The present invention is further directed to a product spacer for use with a product display and dispensing system including a tray having a rear end, a front end, a front wall at the front end and a side wall extending between the rear end and the front end, and a pusher member movably supported between the rear end and the front end for pushing a series of products towards the front end. The product spacer includes a body configured for mounting to the side wall and at least one wing projecting from the body for engaging a frontward most product of a series of products to space the frontward most product from the front wall. The product spacer preferably includes at least one wing that is resiliently flexible so as to deform towards the rear end of the tray in response to a force applied to the wing.

BRIEF DESCRIPTION OF THE DRAWINGS

FIG. 1 is a fragmentary perspective view of a product display and dispensing system of the present invention displaying and dispensing products.

FIG. 2 is a fragmentary perspective view of a product flow guide of the product display and dispensing system.

FIG. 7 is a sectional view of the product display and dispensing system of FIG. 6 taken along lines 7—7.

DETAILED DESCRIPTION OF THE PREFERRED EMBODIMENT

Figure 3:
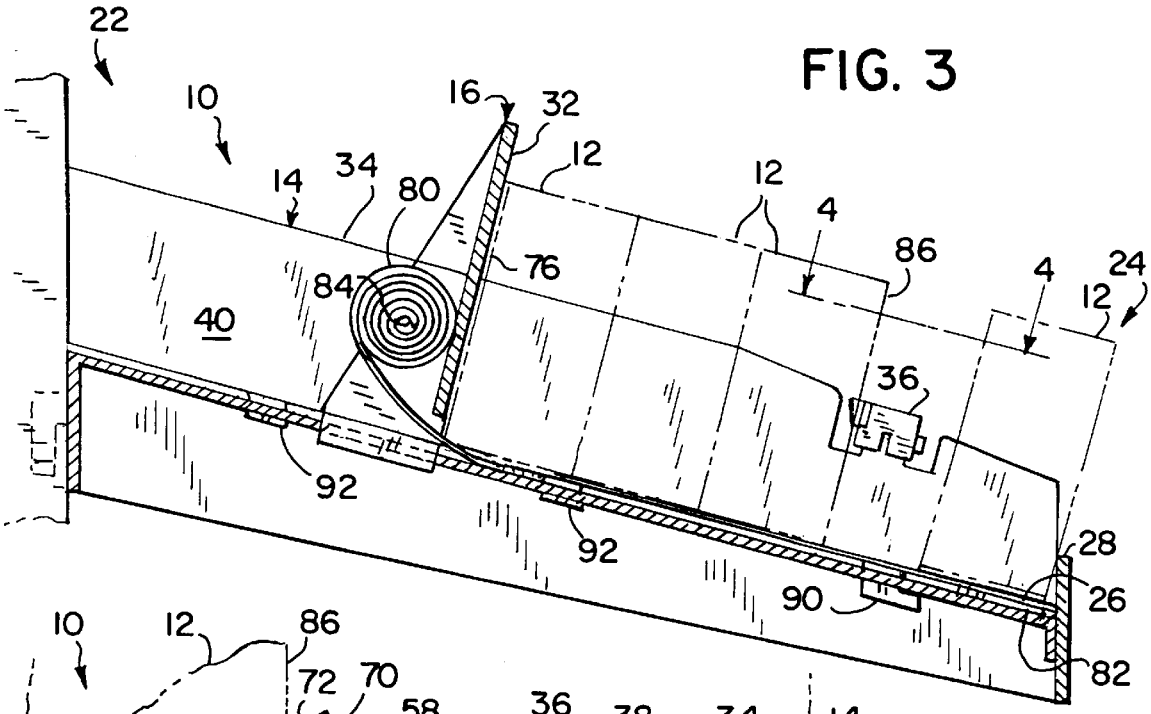
FIG. 3 is a sectional view of the product display and dispensing system containing products.

FIG. 1 is a fragmentary perspective view of a product display and dispensing system 10 for various sized and configured products 12 stacked in rows or series. Product display and dispensing system 10 generally includes trays 14, forward product feed devices 16 and product flow guides 18. Trays 14 are specifically configured for supporting a series of products 12 between a rear end 22 and a front end 24 of each tray 14. Each tray 14 includes a floor 26 and a front wall 28. Floor 26 extends between rear end 22 and front end 24 and is configured for supporting products 12 as products 12 move towards front wall 28. Alternatively, floor 26 may be configured for movably supporting forward product feed device 16 such that forward product feed device 16 carries products 12 towards front wall 28.

Front wall 28 extends along front end 24 of each tray 14 and defines a generally vertical surface for contacting products 12. Front wall 28 preferably projects upwardly from floor 26 a sufficient distance so as to retain products 12 within tray 14. As shown by FIG. 1, a single panel may serve as a front wall for a plurality of side-by-side trays 14.

Forward product feed devices 16 urge each corresponding series of products 12 towards front end 24 of each tray 14. Product feed devices 16 preferably include a pusher member 32 movably supported between rear end 22 and front end 24 of each tray 14. Pusher member 32 engages a rearward most product 12 so as to push the entire series of products 12 towards front end 24. Pusher member 32 is preferably forcefully biased towards front end 24 so as to automatically move the series of products 12 towards front end 24.

Product flow guides 18 guide the flow of products 12 towards front end 24. Product flow guides 18 generally include a support structure 34 and a product spacer 36. Support structures 34 are configured for being supported adjacent tray 14 between rear end 22 and front end 24. In the preferred embodiment illustrated, support structures 34 comprise generally elongate flat panels extending completely between rear end 22 and front end 24 of each tray 14. The panels comprising support structures 34 are preferably positioned adjacent sides of products 12 such that the panels maintain the series of products 12 in an aligned and even row as the series of products are moved towards front end 24 by forward product feed devices 16. As shown by FIG. 1, support structures 34 are preferably positioned between adjacent trays 14 so as to simultaneously guide the forward flow of two series of products 12 towards front end 24. Although support structures 34 preferably comprise elongate panels for directing the flow of products 12 towards front end 24 of each tray 14, another significant function of support structures 34 is to support products spacers 36 adjacent to products 12. Accordingly, support structures 34 may have a variety of alternative sizes and configurations for serving this alternate function. As can be appreciated, the exact thickness, height and length of each panel comprising support structure 34 will vary depending upon the size and configuration of display system 10 as well as the particular product characteristics.

Product spacers 36 are configured for being supported and positioned so as to engage and space a frontward most product 12 of each series of products 12 from front wall 28. Each product spacer 36 includes at least one stop surface 37 extending into contact with a frontward most product 12 at a location intermediate rear end 22 and front end 24. Because each product spacer 36 creates a gap or space between front wall 28 and the frontward most product 12 of each series of products 12, product spacers 36 enable display and dispensing system 10 to be easily reloaded with removed products 12 or with new inventory. As further shown by FIG. 1, because support structures 34 extend forward of product spacers 36 to additionally define the gap, support structures 34 and front wall 28 engage three sides of products 12 reloaded into the gap to securely support products 12 reloaded within the gap.

FIG. 2 is an enlarged fragmentary perspective view of support structure 34 and product spacer 36 of product flow guide 18. As best shown by FIG. 2, support structure 34 preferably supports product spacer 36 and comprises an elongate flat panel including sides 38, 40, top edge 42, recess 44, rear portion 46, front portion 48 and product spacer mount 50. Sides 38 and 40 extend opposite one another for channeling the flow of products in adjacent, side-by-side trays 14 (shown in FIG. 1). Top edge 42 extends between sides 38 and 40. Recess 44 is a void extending below top edge 42 and sized for containing product spacer mount 50 and product spacer 36.

Product spacer mount 50 preferably comprises a tab having projections 52 configured for forming a mechanical interlock with product spacer 36. Product spacer mount 50 supports product spacer 36 within recess 44 and in contact with products 12 within display and dispensing system 10 (shown in FIG. 1). Because product spacer mount 50 supports product spacer 36 within recess 44 below top edge 42, product spacer 36 engages a more central portion of the frontward most product 12. In the preferred embodiment illustrated, product spacer mount 50 is made of a resiliently flexible material, such as styrene, and is dimensioned so as to laterally flex towards and away from sides 38 and 40.

Product spacer 36 mounts upon product spacer mount 50 and generally includes body 56 having wings 58, 60. Body 56 mounts wings 58, 60 to product spacer mount 50 of support structure 34 and is configured for mating with product spacer mount 50. In the preferred embodiment illustrated, body 56 defines a lower open ended hollow interior (not shown) which receives product spacer mount 50. To further secure body 56 to product spacer mount 50, body 56 additionally includes openings 64 and slots 66. Openings 64 extend through opposite ends of body 56 and are sized for receiving projection 52 of product spacer mount 50. As a result, body 56 securely mounts to product spacer mount 50 without the need for adhesives or additional parts. Slots 66 extend upwardly into opposite sides of body 56 to facilitate the positioning of body 56 about product spacer mount 50. Body 56 may alternatively be secured to product spacer mount 50 and to support structure 34 with a variety of other well known fasteners and fastening arrangements.

Wings 58, 60 comprise projections extending outwardly from body 56 so as to contact and engage a frontward most product 12. Because support structure 34 and body 56 extend generally parallel to the axial center lines of trays 14, wings 58, 60 extend laterally outward from body 56 for engaging products 12. Wings 58, 60 extend opposite one another beyond sides 38 and 40, respectively. Wings 58, 60 each preferably include portions 70 and 72. Portion 70 rearwardly and laterally extends from body 56. As a result, portion 70 facilitates movement of products 12 rearwardly towards rear end 22 of tray 14 during loading. Portion 72 extends rearwardly and inwardly from an end of portion 70. Portion 72 contacts and engages products 12.

To facilitate easier loading of products 12 into display and dispensing system 10 and to facilitate easier removal of products 12 from display and dispensing system 10, wings 58 and 60 are preferably made from a resiliently flexible material such as ENGAGE 8401 sold by Dow Chemical such that wings 58, 60 deform towards rear end 22 in response to a rearward force applied to the wing. Wings 58 and 60 are also preferably resiliently flexible so as to be deformable towards the front end 24 in response to a sufficient forward force applied to wing 58, 60 to enable products 12 to be moved forward for removal from display and dispensing system 10. Wings 58 and 60 should each preferably have a sufficient strength so as to oppose the forward directed forces applied to products 12 by forward product feed devices 16. Although wings 58 and 60 may slightly deform as a result of the forward directed forces applied by forward product feed devices 16, wings 58, 60 preferably maintain a minimal grip upon a frontward most product 12 so as to prevent the frontward most product 12 from being forced forwardly against front wall 28 of each tray 14. Thus, wings 58, 60 space the frontward most product 12 from front wall 28 (shown in FIG. 1) for easier loading and reloading of display and dispensing system 10. The exact materials, shapes and dimensions of wings 58, 60 will vary depending upon the configuration of products 12 and the amount of forward directed force that ultimately must be opposed by wings 58, 60.

FIG. 3 is a sectional view taken along an axial center line of a tray 14 of product display and dispensing system 10. FIG. 3 illustrates forward product feed device 16 in greater detail. As shown by FIG. 3, pusher member 32 mates with floor 26 of tray 14 for movement along floor 26 between rear end 22 and front end 24 of tray 14. Pusher member 32 contacts a rearwardly facing surface 76 of a rearward most product 12 to force the series of adjacent products 12 towards front end 24.

In the preferred embodiment illustrated, forward product feed device 16 utilizes a coil spring 80 and gravity to apply a forwardly directed force to pusher member 32 and the series of adjacent products 12. Coil spring 80 has a first end 82 mounted towards front end 24 of tray 14 and a second opposite end 84 coiled behind pusher member 32. Coil spring 80 preferably extends along floor 26 and within a groove of floor 26 between front wall 28 and pusher member 32. Coil spring 80 recoils to force pusher member 32 and a series of adjacent products 12 towards front end 24. At the same time, coil spring 80 permits a shelf stocker or a customer to force products 12 and pusher member 32 rearwardly towards rear end 22 so as to uncoil coil spring 80 for reloading tray 14 with additional products 12.

As shown by FIG. 3, floor 26 preferably slopes downwardly from rear end 22 towards front end 24. As a result, pusher member 32 and the series of adjacent products 12 are urged toward front end 24 with the assistance of gravity. Although forward product feed device 16 is illustrated as utilizing both gravity and coil spring 80 to apply a forward force to pusher member 32 and the series of adjacent products 12, forward product feed device 16 may alternatively utilize only gravity or only coil spring 80 to force pusher member 32 and products 12 towards front end 24. As can be appreciated, a variety of other well known springs, combination of springs and other biasing mechanisms may be used in lieu of coil spring 80.

As further shown by FIG. 3, product spacer 36 opposes a forwardly directed force applied by forward product feed device 16. Product spacer 36 preferably engages a frontward most surface 86 of a frontward most product 12 of a series of adjacent products 12 to space the frontward most surface 86 from front wall 28 of tray 14. Product spacer 36 preferably spaces surface 86 of the frontward most product 12 from front wall 28 by a distance greater than or equal to the maximum dimension of product 12 extending parallel to the axial center line of tray 14 between rear end 22 and front end 24. In the preferred embodiment illustrated, product spacer 36 engages front surface 86 to space front surface 86 of the frontward most product 12 from front wall 28 by a distance greater than one and one half times the thickness of an individual product 12 extending between rear end 22 and front end 24. Because product spacer 36 spaces front surface 86 of a frontward most product 12 from front wall 28 by a distance greater than the width of a single product 12, product 36 creates a gap between front wall 28 and surface 86 sufficiently sized for receiving an additional product 12. Consequently, a product 12 initially removed by a customer for inspection can be easily replaced by the customer in the gap created by product spacer 36.

Moreover, during reloading of product display and dispensing system 10, the gap created by product spacer 36 may contain new products 12 added by the shelf stocker prior to the shelf stocker forcing the added products 12 within the gap rearwardly past product spacer 36 against the forward directed force of feed device 16. Because the required dimension of the gap between front wall 28 and surface 86 will vary depending upon the maximum thickness of an individual product 12, support structures 34 are removably mounted to tray 14. Accordingly, support structures 34 preferably include downwardly extending locking feet 90, 92 which extend through corresponding apertures within floor 26 to removably secure support structure 34 and product spacer 36 to tray 14. Because support structure 34 may be easily removed and replaced, other support structures 34 supporting product spacers 36 at different locations may alternatively be used depending upon the necessary size of the gap between front wall 28 and surface 86 of the frontward most product 12.

Figure 4:
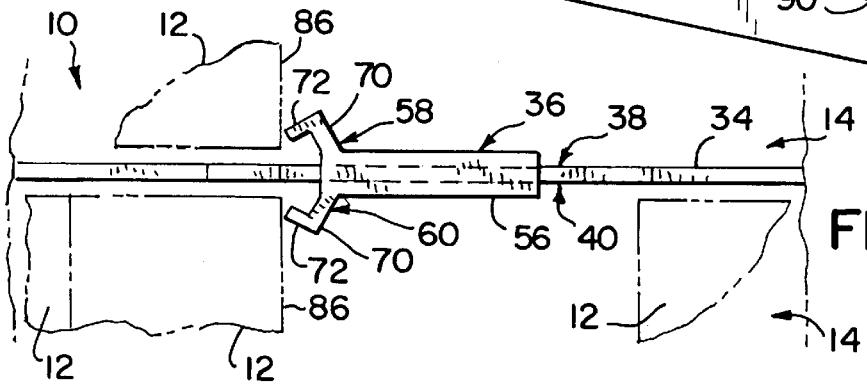
FIG. 4 is a top elevational view of the product display and dispensing system of FIG. 3 taken along lines 4—4.

FIG. 4 is a sectional view of product spacer 36 engaging products 12 taken along lines 4—4 of FIG. 3. As best shown by FIG. 4, body 56 of product spacer 36 mounts to support structure 34 between sides 38 and 40 of support structure 34 and between adjacent trays 14 of product display and dispensing system 10. Body 56 supports wings 58 and 60 in simultaneous engagement with frontward most products 12 within adjacent trays 14. In particular, portion 72 of wing 58 engages frontward most surface 86 of product 12 adjacent side 38 of support structure 34 while portion 72 of wing 60 engages frontward most surface 86 of product 12 adjacent side 40 of support structure 34. Because product spacer 36 extends between adjacent trays 14, product spacer 36 simultaneously spaces products 12 in both adjacent trays 14.

As shown by FIG. 4, wings 58 and 60 of product spacer 36 engage only the frontward most corners of products 12 to space products 12 from front wall 28 (shown in FIG. 3). Wings 58 and 60 of product spacer 36 do not engage and overlap a substantial portion of the frontward most surfaces 86 of products 12. Consequently, the product spacers 36 do not substantially interfere with the visual inspection of products 12 within product display and dispensing system 10.

Figure 5:
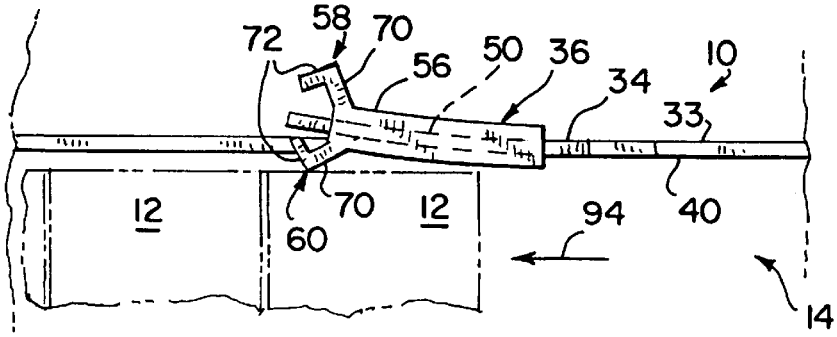
FIG. 5 is a top elevational view of the product display and dispensing system illustrating products being loaded into the product display and dispensing system.

FIG. 5 is a top elevational view of product display and dispensing system 10 illustrating products 12 being loaded into product display and dispensing system 10. As discussed above with respect to FIG. 3, each new product 12 to be loaded into product display and dispensing system 10 is preferably first positioned within the gap created by product spacer 36 between front wall 28 and the frontward most surface 86 of the frontward most product 12 engaged by product spacer 36. Once positioned within the gap, a newly loaded product 12 is pushed rearwardly towards rear end 22 as indicated by arrow 94. During the rearward movement of the newly loaded product 12, spacer mount 50 of support structure 34 resiliently deforms or flexes to move wing 60 of product spacer 36 away from products 12 within tray 14. During rearward movement of the newly loaded product 12, wing 60 also resiliently deforms away from the newly loaded product 12 towards rear end 22 and towards opposite side 38 of support structure 34.

Once the newly loaded product 12 is moved rearwardly past wing 60 of product spacer 36, product spacer 36 resiliently returns to its original position such that wing 60 grasps the corresponding frontward most surface of the newly loaded product 12 to space the newly loaded product from front wall 28. Because product spacer 36 automatically returns to its initial position to engage a frontward most surface of the newly loaded product 12, product spacer 36 automatically captures the newly loaded product 12 against the former frontward most product 12. Thus, product spacer 36 grasps each newly loaded product 12 to prevent the newly loaded product 12 from tipping forward into the gap as additional inventory of product 12 are loaded into product display and dispensing system 10. Additional new inventory of product 12 may be loaded into the gap and forced rearwardly beyond product spacer 36 as desired. As a result, new inventory of products 12 may be easily loaded into product display and dispensing system 10.

Figure 6:
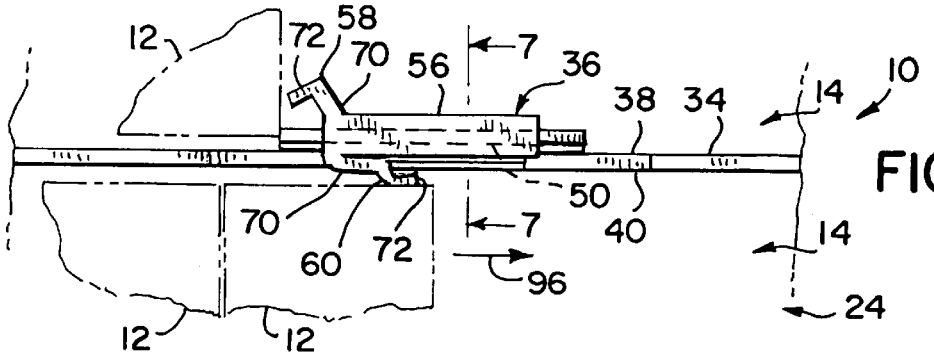
FIG. 6 is a top elevational view of the product display and dispensing system illustrating products being removed from the product display and dispensing system.

FIGS. 6 and 7 illustrate the removal of products 12 from product display and dispensing system 10. FIG. 6 is a top elevational view of product display and dispensing system 10. FIG. 7 is a sectional view of product display and dispensing system 10 taken along lines 7—7 of FIG. 6. As shown by FIG. 6, during forward movement of product 12, as indicated by arrow 96, wing 60 resiliently deforms or flexes towards front end 24. At the same time, as shown by FIG. 7, product spacer mount 50 resiliently deforms and flexes away from product 12. As a result, the frontward most product 12 contained within tray 14 may be easily moved forward to within the gap created by product spacer 36. Once the frontward most product 12 has been moved forwardly into the gap adjacent front wall 28, the product 12 may be simply lifted from the gap. Once the frontward most product 12 has been moved forwardly past product spacer 36, product spacer mount 50 and wing 60 resiliently return to their original positions so as to automatically grasp and engage the next rearwardly succeeding product 12.

As shown by FIG. 6, wing 60 resiliently deforms towards front end 24 independent of wing 58. Although product spacer mount 50 resiliently deforms to move product spacer 36 away from the product 12 being removed, the deformation of product spacer mount 50 does not substantially interfere with wing 58 engaging the frontward product 12 of an adjacent tray 14. Thus, despite the fact that a single product spacer 36 is utilized for two adjacent trays 14, products 12 within the adjacent trays 14 may be removed independently of one another.

Although the present invention has been described with reference to preferred embodiments, workers skilled in the art will recognize that changes may be made in form and detail without departing from the spirit and scope of the invention.

What is claimed is:

1. A product display and dispensing system, comprising:

a first tray configured for supporting a series of products between a rear end and a front end of the first tray, wherein the first tray includes a front wall at the front end;

a first sidewall proximate the front end and wherein the first stop is supported adjacent the first sidewall; and a pusher member movably supported between the rear end and the front end engaging a rearward most product so as to push the series of products towards the front end; and a first stop surface supported proximate the front end and spaced from the front wall for engaging a frontward most product of the series of products to space the frontward most product from the front wall, wherein the first stop surface is moveable from a first position in which the first stop surface obliquely extends from the side wall at a first angle to a second position in which the first stop surface extends at a second angle relative to the sidewall.

2. The system of claim 1 wherein the first tray includes a second sidewall opposite the first sidewall, wherein the system further includes:

a second stop surface supported by the second sidewall opposite the first stop, wherein the second stop surface is spaced from the front wall for engaging the frontward most product to space the frontward most product from the front wall.

3. The system of claim 1 including:

a second stop surface supported proximate the front end and spaced from the front wall for engaging the frontward most product to space the frontward most product from the front wall.

4. The system of claim 3 wherein the second stop surface is supported opposite the first stop surface for engaging an opposite side of the frontward most product.

5. The system of claim 1 wherein the pusher member engages a first side of the series of products and wherein the stop engages a second opposite side of the series of products.

6. The system of claim 1 wherein the pusher member is resiliently biased towards the front end.

7. The system of claim 6 wherein the system includes a coil spring for resiliently biasing the pusher member towards the front end.

8. The system of claim 1 wherein the first stop surface is resiliently flexible so as to deform towards the rear end of the first tray in response to a rearwardly directed force applied to the first stop surface.

9. The system of claim 1 including:

at least one wing projecting outward from the first sidewall towards the rear end, wherein the at least one wing provides the first stop surface.

10. The system of claim 1 wherein the system includes a second tray adjacent to the first tray, the second tray having a rear end, a front end and a front wall at the front end.

11. The system of claim 10, wherein each product has a front, a back, a thickness between the front and the back and opposite sides, and wherein the system includes:

a body supported parallel to axes of the first and second trays;

a first wing extending from the body into the first tray towards the rear end of the first tray, wherein the first wing provides the first stop surface, the first stop surface being spaced from the front wall of the first tray by a distance greater than the thickness of each product; and a second wing extending from the body into the second tray towards the rear end of the second tray, wherein the second wing provides a second stop surface, the second stop surface being spaced from the front wall of the second tray by a distance greater than the thickness of each product.

12. The system of claim 1 wherein each product of the series of products has a thickness and wherein the product spacer spaces the frontward most product from the front wall by a distance greater than the thickness.

13. A product flow guide for use with a product display and dispensing system having a tray with a front end, a rear end and a front wall at the front end, and a pusher member movably supported between the rear end and the front end for pushing a series of products within the tray towards the front end, the product flow guide comprising:

a support structure configured for being longitudinally supported adjacent the tray between the front end and the rear end of the tray, the support structure including a laterally flexible portion; and at least one wing projecting from the laterally flexible portion of the support structure, wherein the wing is configured for engaging a frontward most product of the series of products to space the frontward most product from the front wall and wherein the support structure laterally flexes to a sufficient degree to facilitate movement of products past the at least one wing.

14. The product flow guide of claim 13 wherein the tray extends along an axis between the rear end and the front end, wherein the support structure extends parallel to the axis and wherein said at least one wing extends oblique to the axis.

15. The product flow guide of claim 13 wherein the support structure comprises:

a sidewall extending along one side of the tray for guiding the series of products from the rear end towards the front end.

16. The product flow guide of claim 15 wherein the sidewall includes a first one of a horizontal male projection member and a female member having a horizontal opening and wherein said at least one wing includes a body having a second one of the male projection member and the female member, wherein the horizontal opening receives the male projection to removably attach the wing to the sidewall.

17. The product flow guide of claim 13 wherein the wing is resiliently flexible so as to resiliently deform towards the rear end of the tray when used with the system.

18. The product flow guide of claim 13 wherein said at least one wing includes:

a first wing projecting from the support structure on a first side of the support structure; and a second wing projecting from the support structure on a second opposite side of the support structure.

19. A product spacer for use with a product display and dispensing system including a tray having a rear end, a front end, a front wall at the front end and a side wall extending between the rear end and the front end, and a pusher member movably supported between the rear end and the front end for pushing a series of products within the tray towards the front end, the product spacer comprising:

a body configured for mounting to the side wall; and at least one resiliently flexible wing projecting from the body for engaging a frontward most product of the series of products to space the frontward most product from the front wall.

20. The product spacer of claim 19 wherein said at least one wing is resiliently flexible so as to deform towards the rear end of the tray in response to a force applied to said at least one wing.

21. The product spacer of claim 19, wherein said at least one wing is resiliently flexible so as to deform towards the front end of the tray in response to a force applied to said at least one wing.

22. A product display and dispensing system comprising:

a tray configured for supporting a series of products between a rear end and a front end of the tray, each product having a front, a back, a thickness between the front and the back and first and second opposite sides, wherein the tray includes a front wall at the front end and a sidewall proximate the front end;

a pusher member moveably supported between the rear end and the front end and engaging a rearward most product so as to push the series of products towards the front end; and a first stop surface supported proximate the front end and spaced from the front end by a distance greater than the thickness of the frontward most product, wherein the first stop surface is configured to extend only partially across the front surface from the first side towards the second side of the frontward most product of the series of products to space the frontward most product from the front wall by a distance greater than the thickness of the frontward most product and to enable visual inspection of the front of the frontward most product between the first stop surface and the second side.

23. The system of claim 22, wherein the first stop surface is moveable from a first position in which the first stop surface obliquely extends from the sidewall at a first angle to a second position in which the first stop surface extends at a second angle relative to the sidewall.

24. The system of claim 22, wherein the sidewall includes a top edge and wherein the stop surface extends from below the top edge.

25. The system of claim 22, including a body supporting the stop surface, wherein the body includes a first one of a male and female connector member and wherein the sidewall includes a second one of a male and a female connector member, wherein the female connector member receives the male connector member to releasably attach the stop surface to the sidewall.

26. A product flow guide for use with a product display and dispensing system having a tray with a front end, a rear end and a front wall at the front end, the product flow guide comprising:

a support structure configured for being longitudinally supported adjacent the tray between the front end and the rear end of the tray; and at least one stop surface projecting from the support structure, wherein the stop surface is configured for engaging a frontward most product of the series of products to space the frontward most product from the front wall and wherein the stop surface is laterally moveable from a first position in which the stop surface sufficiently engages the frontward most product to prevent movement of the frontward most product past the stop surface to a second position in which the stop surface allows the frontward most product to move past the stop surface.

27. The product flow guide of claim 26, wherein the support structure includes a laterally flexible portion and wherein the stop surface is coupled to the laterally flexible portion, whereby the stop surface moves between the first and second positions upon the flexible portion of the support structure flexing.

* * * * *